United States Patent [19]

Orrico

[11] Patent Number: 4,924,040

[45] Date of Patent: May 8, 1990

[54] ELECTRICAL SWITCHING APPARATUS

[75] Inventor: Mario M. Orrico, Chicago, Ill.

[73] Assignee: Illinois Tool Works Inc., Chicago, Ill.

[21] Appl. No.: 911,448

[22] Filed: Sep. 25, 1986

[51] Int. Cl.[5] ..... H01H 15/00; H01H 1/20; H01H 13/50

[52] U.S. Cl. ..... 200/16 A; 200/243

[58] Field of Search ..... 200/16 A, 159 R, 239-243

[56] References Cited

U.S. PATENT DOCUMENTS

| | | | |
|---|---|---|---|
| 3,272,949 | 9/1966 | Lawrence | 200/243 |
| 3,826,885 | 7/1974 | Allen et al. | 200/83 N X |
| 4,224,489 | 9/1980 | Dietrich | 200/16 A X |
| 4,473,727 | 9/1984 | Beck | 200/16 A |
| 4,550,232 | 10/1985 | Lemmer | 200/16 A |
| 4,594,484 | 6/1986 | Lemmer | 200/16 A |

*Primary Examiner*—J. R. Scott

*Attorney, Agent, or Firm*—John P. O'Brein; Thomas W. Buckman

[57] ABSTRACT

A electrical switching apparatus having a housing, an actuator for actuating the apparatus along an axis, first contacts for establishing an incomplete electrical path within the housing and second contacts for bridgingly electrically completing the electrical path in response to movement of the actuator within the housing. The first contacts comprise at least two elongate contacts and the second contacts comprise at least one elongate bridging contact or in a generally perpendicular to the axis of the housing. Second contacts are floatingly captive to the actuator in a manner allowing movement of those second contacts with respect to the first contacts in at least one axis.

4 Claims, 2 Drawing Sheets

ELECTRICAL SWITCHING APPARATUS

BACKGROUND OF THE INVENTION

The present invention is directed to an electrical switching apparatus which is preferably in the form of a pushbutton switch. The present invention is designed, particularly in the aspect of its electrical contact structure, to provide a reliable switching action which may be easily manufactured; the design is forgiving of tolerances which may be required by prior art devices in the alignment of contacts to ensure reliability of operation.

SUMMARY OF THE INVENTION

The invention is an electrical switching apparatus having a housing and an actuator for actuating the apparatus along an axis. Contained within the housing are first contact means for establishing an incomplete electrical path within the housing and second contact means, carried upon the actuator, for bridgingly electrically completing the electrical path established by the first contact means in response to movement of the actuator means within the housing. In the preferred embodiment of the present invention, the first contact means comprise a pair of elongate contacts oriented in a plane substantially perpendicular to the axis of the housing along which the actuator moves. The second contact means, carried upon the actuator, comprise a second pair of elongate contacts which are electrically in common and are free to effect a limited amount of movement about two axes.

Thus, tight tolerances in maintaining the first contact means within a plane during manufacture of the device are not required since there is a duplication of bridging contact action effected by the two elongate contacts comprising the second bridging contact means and, especially, since the bridging contact means can rotate about two axes to accommodate any misalignment of the first contact means which may occur because of misalignment during manufacture, uneven wear during operation of the switch, or the like.

In the most preferred embodiment of the present invention, the electrical contacts of both the first contact means and the second contact means are substantially triangular in cross-section and arranged so that the respective apexes of the various triangular cross-sections are presented to each other in the construction of the switch. In this manner, the contact effected between the first contact means and the second contact means is through respective apexes of triangular cross-sections. This arrangement of contacts provides an advantage by presenting a smaller contact area, thereby lessening the chance of contaminants adhering to the contact area and interfering with the operation of the switch.

It is therefore an object of this invention to provide an electrical switching apparatus which is simple in construction and provides reliabiity and durability in its operation.

A further object of this invention is to provide an electrical switching apparatus which is less susceptible to fouling by contaminants which may enter the device than is the case with some prior art devices.

Yet a further object of this invention is to provide an electrical switching apparatus which is forgiving of tolerances in its manufacture.

Still a further object of this invention is to provide an electrial switching apparatus which provides redundancy of contact function.

A further object of this invention is to provide an electrical switching apparatus which is self aligning during its operation.

Further objects and features of the invention will be apparent from the following specification and claims when considered in connection with the accompanying drawings illustrating the preferred embodiment of the invention.

DETAILED DESCRIPTION OF THE DRAWINGS

DETAILED DESCRIPTION OF THE INVENTION

Figure 1:
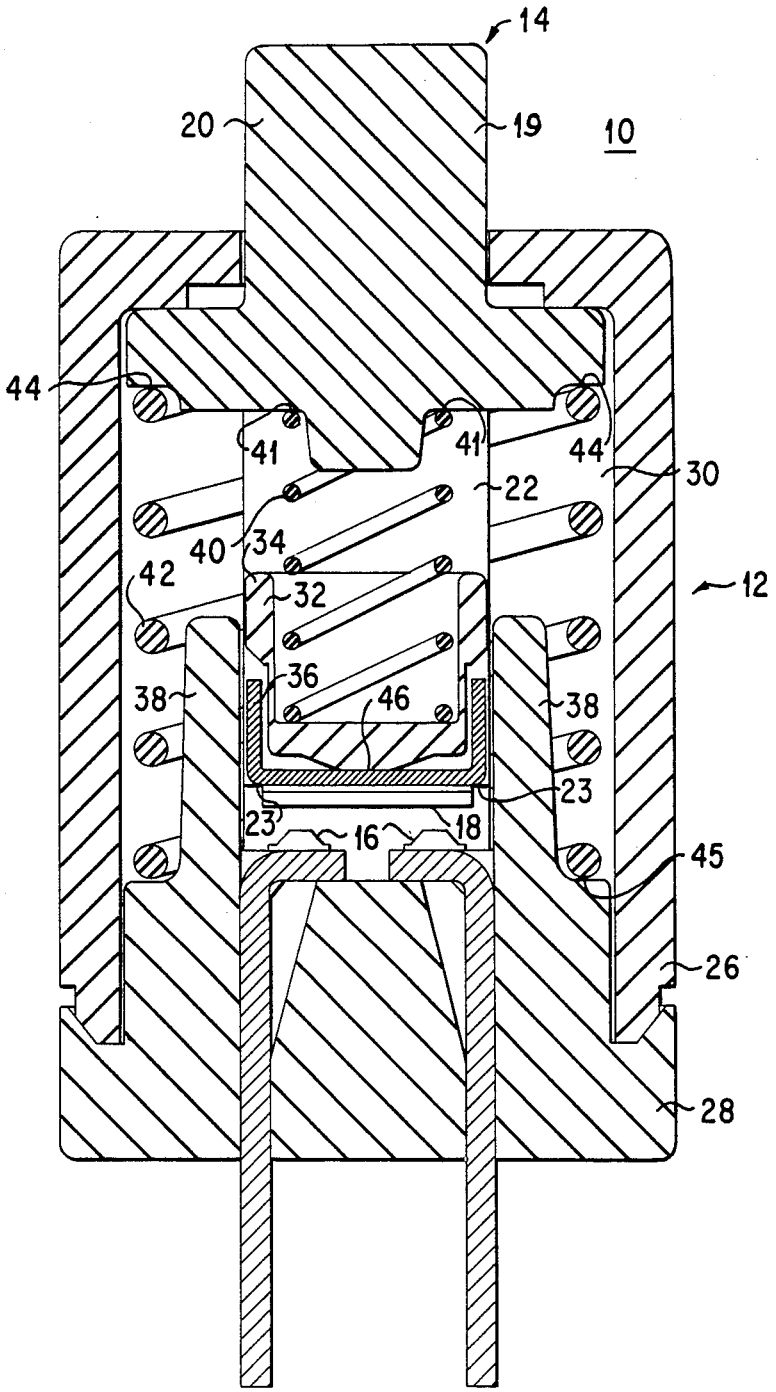
FIG. 1 is a side view of a schematic section drawing of the preferred embodiment of the present invention.

For purposes of ease of understanding the invention disclosed herein, like elements will be given like reference numerals as they appear in the various drawings.

The preferred embodiment of the an electrical switching apparatus 10 is shown schematically in section in FIG. 1. The electrical switching apparatus 10 is comprised of a housing 12, an actuator assembly 14, fixed contacts 16 and moveable contacts 18.

The housing 12 is preferrably formed in a top section 26 and a bottom section 28 which are affixed to each other to form a unitary housing 12 after assembly of the electrical switching apparatus 10.

There is a cavity 30 defined within the housing 12 within which cavity 30 the actuator assembly 14 is capitively moveably held, as will be described hereinafter in greater detail.

The actuator assembly 14 is comprised of a plastic carriage 19 which is formed to provide a pushbutton 20 and a pair of legs 22. An internal cavity 24 is formed between the legs 22. At the bottom of each leg 22 is a shoulder 23 which serves to capture within the internal cavity 24 the moveable contact carrier assembly 32. The moveable contact carrier assembly 32 is comprised of a contact carrier 34 and a moveable contact array 36 on which are attached moveable contacts 18.

Figure 2:
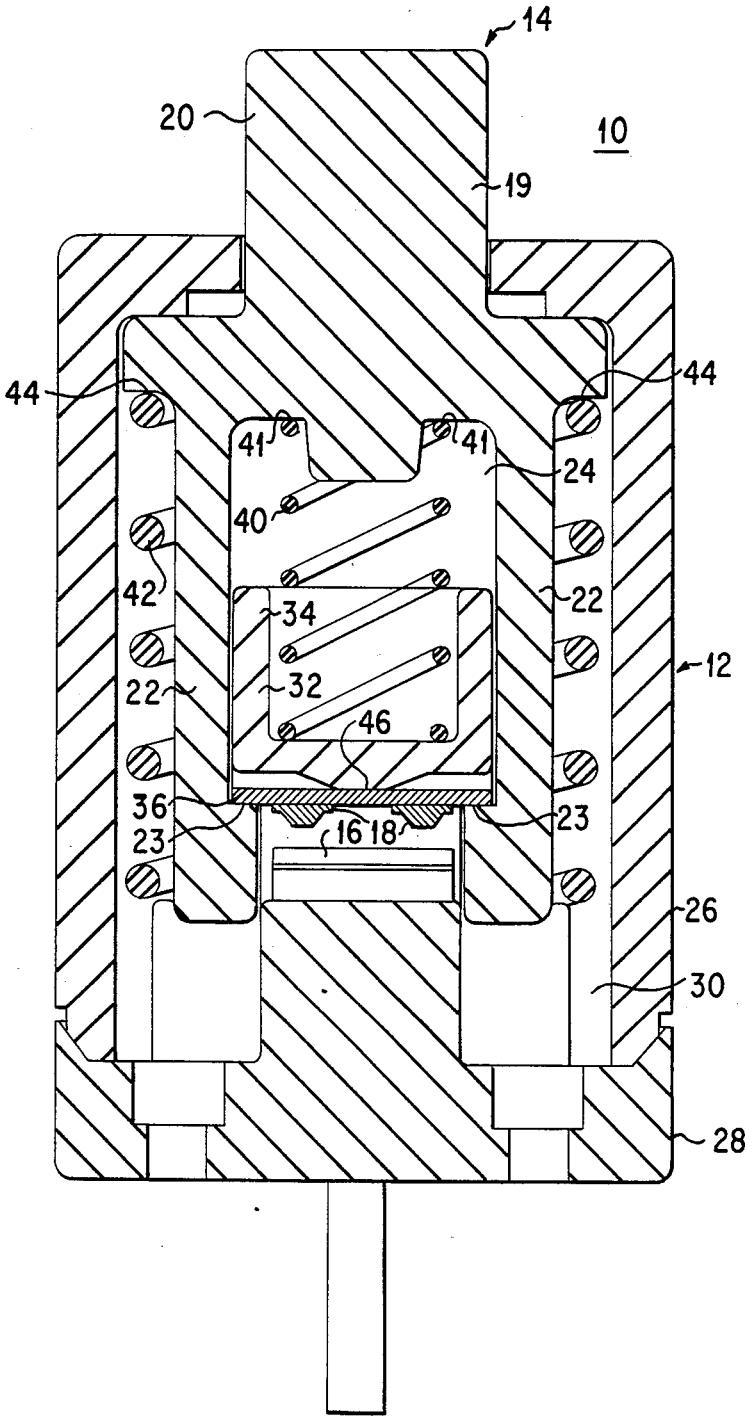
FIG. 2 is a side view of a schematic section drawing of the preferred embodiment of the present invention as viewed in an orientation 90° displaced from the view provided in FIG. 1.

The moveable contact carrier assembly 32 is retained within the internal cavity 24 in one direction by the legs 22 (see FIG. 2) and in a second direction by uprights 38 (see FIG. 1) which are integrally formed as a portion of the bottom section 28 of the housing 12. An overtravel spring 40 is maintained in compression between the upper wall 41 of the internal cavity 24 and the moveable contact carrier 34 to bias the moveable contact carrier assembly 32 against the shoulder 23 of the actuator assembly 14.

The actuator assembly 14 is biased upward in a non-contacting position within the cavity 30 by an actuator spring 42 which is maintained in compression between a shoulder 44 of the plastic carriage 19 and a shoulder 45 which is integrally formed as a portion of the bottom section 28 of the housing 12. Preferrably the actuator spring 42 has a greater spring constant than the overtravel spring 40 so that when a force is applied to the pushbutton 20 to move the actuator assembly 14 toward the fixed contacts 16 the moveable contacts 18 will contact the fixed contacts 16 and provide a bridging electrical circuit completion between the fixed contacts 16. Further depression of the pushbutton 20 will serve to further depress the actuator spring 42 as well as begin to depress the overtravel spring 40.

After the moveable contacts 18 make contact with the fixed contacts 16 and the overtravel spring 40 begins to compress, misalignment among the moveable contacts 18 and the fixed contacts 16 will be accommodated as the moveable contact array 36, still captively held between the fixed contacts 16 and the contact carrier 34 by the pressure applied to the moveable contacts 18, will be free to rotate about two axes centered on the protrusion 46 formed in the contact carrier 34. It is noteworthy that the moveable contact array 36 is not affixed to the contact carrier 34. The moveable contact array 36 is capitively held between the contact carrier 34 and the shoulders 23 of the actuator assembly 14 when the actuator 14 is in the undepressed position. When the actuator assembly 14 is depressed and the moveable contacts 18 contact the fixed contacts 16 the moveable contact array 36 is thereafter capitively held by the pressure applied to it through moveable contacts 18 to continue to hold the moveable contact array 36 against the protrusion 46 of the contact carrier 34.

Thus by providing a non-fixed relationship between the moveable contact array 36 and the contact carrier 34, with the moveable contact array 36 positively biased against the protrusion 46, the moveable contact array 36 is free to rotate slightly about two axes about the protrusion 46. Specifically, the moveable contact array 36 may rotate about a first rotational axis substantially parallel to upright 38 and about a second rotational axis substantially parallel with legs 22, the first and second rotational axes defining a plane substantially perpendicular to the uprights 38 and the legs 22.

Of course, depending upon the clearances provided among the uprights 38, the moveable contact array 36, and the contact carrier 34, there may be some capability of the moveable contact array 36 to move in a third axis in its accommodation of any non-planar orientation of the fixed contacts 16.

By providing a pair of moveable contacts 18 to bridge the pair of fixed contacts 16, four points of contact between the moveable contacts 18 and the fixed contacts 16 are provided. Thus, since the moveable contacts 18 are electrically in common through the moveable contact array 36, a dual bridging electrical path is provided to even further accommodate misalignment from a planar relationship by the fixed contacts 16.

Thus it is not a requirement that stringent tolerances be established in the manufacture of the present invention to ensure that the fixed contacts 16 define a plane or that the moveable contacts 18 precisely contact the fixed contacts 16 upon depression of the actuator assembly 14. Moreover, as the number of operations of the apparatus increases, there may be some wear of the moveable contacts 18 or the fixed contacts 16 which would, over time, change the relationship between the moveable contacts 18 and the fixed contacts 16. The present invention provides accommodation of such changes in spacial relationships as the switch is operated.

It is to be understood that, while the detailed drawings and specific examples given described preferred embodiments of the invention, they are for the purpose of illustration only, that the apparatus of the invention is not limited to the precise details and conditions disclosed and that various changes may be made therein without departing from the spirit of the invention which is defined by the following claims.

I claim:

1. An electrical switching apparatus comprising a housing, an actuator means for actuating the apparatus along an axis, first contact means for establishing an incomplete electrical path within said housing, and second contact means for bridgingly electrically completing said electrical path in response to movement of said actuator means within said housing; said first contact means comprising at least two substantially rigid elongate contacts generally coplanar in a plane substantially perpendicular to said axis, said second contact means comprising at least two substantially rigid elongate bridging contacts orientated generally perpendicular to said axis; said first contact means being orientated about a first elongate contact axis and said second contact means being orientated about a second elongate contact axis, said first elongate contact axis being substantially perpendicular to said second elongate contact axis; said second contact means being floatingly captive to said actuator means in a manner allowing movement of said second contact means with respect to said first contact means about at least one of said first and said second elongate contact axes.

2. An electrical switching apparatus as recited in claim 1 wherein said second contact means may move with respect to said first contact means simultaneously about both of said first and said second elongate contact axes.

3. An electrical switching apparatus comprising a housing, said housing defining an internal cavity having an axis; an actuator means for actuating the apparatus, said actuator means being axially moveable within said cavity; a first contact means for establishing an incomplete electrical path within said cavity, said first contact means comprising two elongate contacts generally defining a plane substantially perpendicular to said axis; and second contact means for bridgingly electrically completing said electrical path in response to movement of said actuator, said second contact means comprising at least two elongate bridging contacts generally defining a plane perpendicularly to said axis, said first contact means being orientated about a first elongate contact axis and said second contact means being orientated about a second elongate contact axis, said first elongate contact axis being substantially perpendicular to said second elongate contact axis; said second contact means being rotatable about at least one of said first and said second elongate contact axes.

4. An electrical switching apparatus as recited in claim 3 wherein said second contact means is rotatable simultaneously about both of said first and said second elongate contact axes.

* * * * *